US006404390B2

(12) United States Patent
Sheen

(10) Patent No.: US 6,404,390 B2
(45) Date of Patent: Jun. 11, 2002

(54) WIDEBAND MICROSTRIP LEAKY-WAVE ANTENNA AND ITS FEEDING SYSTEM

(75) Inventor: Jyh-Wen Sheen, Ilan Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/764,753

(22) Filed: Jan. 18, 2001

(30) Foreign Application Priority Data

Jun. 2, 2000 (TW) ..... 89110770 A

(51) Int. Cl.[7] ..... H01Q 1/38
(52) U.S. Cl. ..... 343/700 MS
(58) Field of Search ..... 343/700 MS, 792.5, 343/739; 333/26, 128; H01Q 1/38

(56) References Cited

U.S. PATENT DOCUMENTS 6,094,176 A * 7/2000 Van Hoozen et al. .... 343/792.5

* cited by examiner

*Primary Examiner*—Michael C. Wimer
(74) *Attorney, Agent, or Firm*—Darby & Darby

(57) ABSTRACT

A wideband microstrip leaky-wave antenna, comprising a plurality of sections of antenna. Each section of antenna includes a major part of microstrip antenna, each of which has different and continuous width parameters and is connected serially by the way in which the width parameters of major part of microstrip are decreasing. Each band of each antenna's section constructs a continuous antenna's band. In addition, to prevent characteristic of bandwidth from limiting, the antenna can include a wideband feeding system. The wideband feeding system comprises at least one conductor-backed coplanar strips connected to major part of wideband antenna, a balun connected to the conductor-backed coplanar strip, and an input microstrip connected to the balun. The input microstrip is utilized for energy input, then transmitting energy to the end of the section antenna through the conductor-backed coplanar strip and the balun.

11 Claims, 5 Drawing Sheets

WIDEBAND MICROSTRIP LEAKY-WAVE ANTENNA AND ITS FEEDING SYSTEM

BACKGROUND OF THE INVENTION

1. Field of the Invention

The present invention generally relates to the technique of antennas. More specifically, the present invention relates to microstrip leaky-wave antennas utilized for wideband applications and its feeding system.

2. Description of the Prior Art

A leaky-wave antenna is generally utilized for high-frequency applications, especially for millimeter waves. Compared with traditional resonant antennas, the leaky-wave antenna has such advantages as higher manufacturing tolerance, simpler shaping and easier integration with feeding system, etc. In addition to the advantages mentioned above, because a leaky-wave antenna has a characteristic that the direction of the major lobe in the radiation pattern can vary in angle as the change of the operating frequency, it also can be utilized as a frequency-scanning antenna.

In general, there are two kinds of leaky-wave antennas for generating radiated waves. The first one utilizes periodic structure. That is, the energy in this kind of leaky-wave antenna is emitted by structural periodic disturbances that cause spacial harmonics, such as dielectric grating, metal plate grating, and slot grating on a metal slice. The second one utilizes open waveguides having the same shapes. Energy emission in this kind of leaky-wave antenna is achieved by the way in which the operation frequency of the propagation mode is assigned near to the cut-off region, such as groove waveguides, non-radiative dielectric waveguides and microstrips.

Because the microstrip line is manufactured by metal, its energy loss will much higher than that of leaky-wave antennas manufactured by high-Q(quality) dielectrics. In addition to being widely applied to various high-frequency applications, the microstrip leaky-wave antenna has various advantages, such as simple structures and easily manufacturing. Therefore, it is especially appropriate for the applications of integrated antennas and low-cost commercial antennas, etc.

FIG. 1 (PRIOR ART) is the perspective view of the conventional microstrip leaky-wave antenna. Microstrip leaky-wave antenna 10 is a strip of metal and placed at one side of dielectric material 20. The other side of dielectric material 20 is connected to a grounded metal plate 30. In addition, the width of microstrip leaky-wave antenna 10 is represented by W, the thickness of dielectric material 20 is represented by h, and the dielectric constant is represented by $\epsilon r$. In general, dielectric constant is about larger than 2. The microstrip leaky-wave antenna should be operated around the cut-off region by utilizing the first higher order mode. Usually, the propagation way pertaining to the higher order modes in microstrips can be divided into four frequency regions as shown in FIG. 2 (PRIOR ART), which shows the relation between the normalized higher order mode phase constant (denoted by $\beta$/Ko) and the normalized attenuation constant (denoted by $\alpha$/Ko) to the frequency (denoted by f). In FIG. 2, the phase constant of the higher order mode in the microstrip is represented by $\beta$, the attenuation constant of the first higher order mode in the microstrip is represented by $\alpha$, and the wave number in air is represented by Ko. The curve of the normalized higher order mode phase constant $\beta$/Ko and the curve of the normalized attenuation constant $\alpha$/Ko in FIG. 2 are represented by numerals 1 and 2, respectively. As shown in FIG. 2, there are four regions from high frequency to low frequency.

(I) Bound mode region

In this region, the normalized higher order mode phase constant $\beta$/Ko is larger than 1 and the normalized attenuation constant $\alpha$/Ko is equal to 0. More specifically, the higher order mode phase constant $\beta$ is larger than the phase constant of surface waves on the substrate (represented by $\beta$s). That is, the energy in this region is bound in microstrip line and cannot be emitted.

(II) Surface wave region

In this region, the normalized higher order mode phase constant $\beta$/Ko is between 1 and the normalized phase constant of surface waves on the substrate (i.e., $\beta$s/Ko). A tiny amount of the attenuation constant is also apparent in this region. Due to the fact that the energy carried by the microstrip line leaks in the form of surface waves and cannot be emitted to the air, general antennas cannot utilize this region. Besides, the tiny amount of the attenuation constant represents the energy leakage in the form of surface waves.

(III) Space wave region

In this region, the normalized higher order mode phase constant $\beta$/Ko is lower than 1. It means that the energy can be coupled to be the surface waves and the space waves. Due to the fact that most of the energy is coupled to the air, this region can be used to implement antennas. Besides, the attenuation constant in this region is larger than that in the surface wave region, which means the energy leakage of surface waves and space waves in physics.

(IV) Cut-off mode region

In this region, the attenuation constant is larger than the phase constant, which means that the cut-off feature can dominate the operation of the microstrip lines. Therefore, this region cannot be used in the applications of energy emission. Most of the fed signal energy will be reflected. Therefore, it is difficult to design appropriate antenna structures and the energy emission of such antennas is not efficient. Due to the reasons mentioned above, this region is not appropriate for antenna applications.

According to these kinds of microstrip higher order mode regions mentioned above, the microstrip leaky-wave antenna can be appropriately operated in the space wave region, more specifically, by using the first higher order mode operated near the cut-off region. The cut-off frequency of the higher order modes of the microstrip can be described in details as follows. The microstrip leaky-wave antenna is different to the closed waveguide. There is no obvious separation between neighboring operation regions like the closed waveguide due to the leaked energy near the cut-off region. In fact, the phase constant of the closed waveguide has an imaginary part ($Y = j\beta$) in the higher frequencies at the separation point, which means that the wave can be propagated. In addition, there is a real number ($Y = \alpha$) of the propagation constant in the lower frequencies at the separation point, which means the attenuation of the propagated energy. On the contrary, there are no specific cut-off separation points for open microstrip higher order mode waves. For example, using the cavity model, the cut-off frequency of the microstrip leaky-wave antenna structure shown in FIG. 1 can be roughly defined as:

$$f_c = \frac{c}{2W\sqrt{\varepsilon_r}} \tag{1}$$

Wherein the light speed is represented by c, the width of microstrip 10 is represented by w, and the relative permittivity of dielectric material 20 is represented by $\epsilon r$. Next, the frequency bandwidth is described as follows. As described above, the space-wave mode is the most appropriate one for antenna applications and the normalized propagation constant is between 1 and the cut-off point. Using this relation, the radiation bandwidth can be deduced as:

$$f_c < f < \frac{f_c\sqrt{\varepsilon_r}}{\sqrt{\varepsilon_r - 1}} \tag{2}$$

As mentioned above, the dielectric constant of the substrate is usually larger than 2. The maximum usable bandwidth of the traditional microstrip leaky-wave antennas, according to the radiation bandwidth defined in equation (2), is about 40%. The usable bandwidth in practical applications usually cannot reach even 20% while considering other factors such as the bandwidth of the feeding system, the limitation of the antenna size (length) and the antenna gain etc.

Besides, the characteristic that the direction of major lobe will be varied in angle as the change of the operating frequency can be described by using the equation below. In other words, by the concept of whether phase angle is matched, the angle of the major lobe θ of the antenna can be determined as the equation below:

$$\theta = \cos^{-1}\frac{\beta}{k_0} \tag{3}$$

The phase constant β can change as the varying operating frequency. According to equation (3), the angle of the major lobe θ also changes during using the antenna. These kinds of antennas can be utilized for applications of phase array antennas by utilizing the characteristic above. That is, one scanning dimension is controlled by utilizing conventional phase shifters and the other scanning dimension is controlled by utilizing the change of the operating frequency. Therefore, phase shifters originally used in the one-dimensional control mechanism for these phase array antennas can be waived. Utilizing the microstrip leaky-wave antenna to manufacture a phase array antenna is low-cost due to the reduction of the expensive phase shifters. On the other hand, high-gain antennas, or called the point-to-point satellite receiver antennas, can also be manufactured by utilizing the microstrip leaky-wave antenna. However, the shift of the main beam in this kind of antennas will cause a problem in their application. More specifically, if these antennas are applied to the narrow bandwidth applications, such as around 1% of the bandwidth, the shift of the main beam is quite small. However, if these antennas are applied to wide-band applications, such as larger than 10% of the bandwidth, the shift amount of the main beam is huge based on equation (3). It will cause such problems as disturbance or the degradation of the system quality for the point-to-point communication.

According to the reasons mentioned above, the microstrip leaky-wave antenna could be easily applied for some specific applications, but not appropriate for some other applications due to their characteristics. According to equation (2), for example, the bandwidth of the microstrip leaky-wave antenna is narrow, which makes it difficult to be applied for wideband applications.

In addition, the bandwidth of the feeding structure also must be large enough to achieve the optimal bandwidth of the antenna in practical applications. Otherwise, the inherent bandwidth of the antenna would be limited. Generally, the feeding structure utilizes the scheme of one-mode excitation to avoid the loss of coupled energy. FIG. 3 (PRIOR ART) shows the schematic view of a conventional microstrip leaky-wave antenna. In FIG. 3, numeral 100 represents the microstrip in the leaky mode, and numeral 110 represents the microstrip in the exciting bound mode. The exciting bound mode can be one of the microstrip line dominant mode, the slotline dominant mode and the conductor-backed coplanar strips dominant mode (abbreviated by CBCPS). In addition, there is a feeding transition 200 between microstrips 100 and 110, for transforming the modes at the both sides. FIG. 4 (PRIOR ART) shows the layout diagram of the microstrip leaky-wave antenna virtually utilized in the CBCPS feeding system. In addition, FIG. 4 also marks the parts corresponding to the components of the microstrip leaky-wave antenna shown in FIG. 3. Besides, one side of microstrip 110 is connected to a high frequency connector 130 (such as the SMA-type connector) utilized for feeding energy.

SUMMARY OF THE INVENTION

Therefore, an object of the present invention is to provide a wideband microstrip leaky-wave antenna, which has an increased operating bandwidth and can be utilized for various diverse communication applications.

Another object of the present invention is to provide an antenna feeding structure, which can be applied to wideband microstrip leaky-wave antennas, thereby preventing from unnecessarily limiting the antenna bandwidth.

The present invention achieves the above-indicated objects by providing a wideband microstrip leaky-wave antenna including a plurality of antenna sections. Each antenna section includes a microstrip line, which is utilized for leaking energy. The microstrip lines of these antenna sections have different and continuous widths, and these antenna sections are connected sequentially by the way in which the widths of the microstrip lines decrease. The band of these antenna sections depend on their corresponding widths, and these bands of the antenna sections constructs the bandwidth of the whole antenna.

In addition, such a wideband microstrip leaky-wave antenna can be connected to a feeding system that does not limit the bandwidth of the antenna. The feeding system comprises at least one pair of conductor-backed coplanar strips (CBCPS) connected to one end of the connected antenna sections, a balun connected to the CBCPS and an input microstrip line connected to the balun. The input microstrip line is utilized as energy input and transmits the received energy to the end of the connected antenna sections through the CBCPS and the balun. In addition, a metal bottom plate is located under the CBCPS and a dielectrics layer is located between the CBCPS and the metal bottom plate. The CBCPS represents a pair of microstrip lines for transmitting signals with equal amplitudes and the phase differences of 180°, or for coupling the odd modes in the microstrip lines.

In addition, the antenna feeding system can also be utilized for dual-major-lobe applications. That is, the antenna feeding system is utilized for connecting a first microstrip line and a second microstrip line, and transmitting energy to the first microstrip line and the second microstrip line. The first microstrip line and the second microstrip are wave-emission sources with symmetrical major lobe's directions. The antenna feeding system comprises at least one first CBCPS connected to one end of the first microstrip line, at least one second CBCPS connected to one end of the second microstrip line, a balun for connecting the first CBCPS at one side and connecting the second CBCPS at the other opposite side, and an input microstrip line connected to the balun for transmitting energy to the first microstrip line and the second microstrip line through the first CBCPS, the second CBCPS and the balun.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE INVENTION

Figure 1:
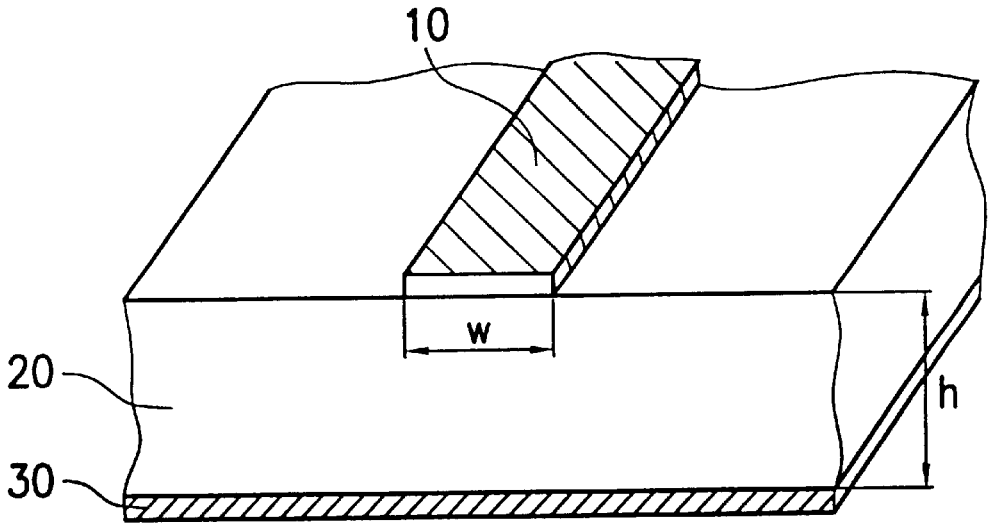
Fig. 1 (PRIOR ART)
FIG. 1 (PRIOR ART) is a perspective view of the conventional microstrip leaky-wave antenna.
Figure 2:
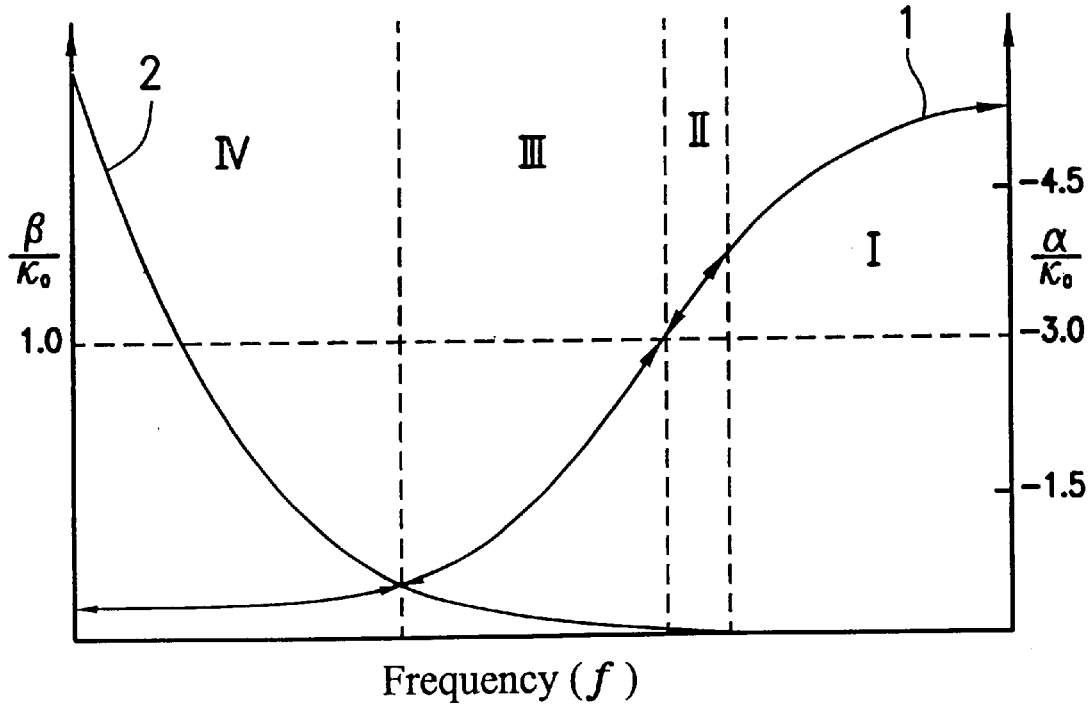
Fig. 2 (PRIOR ART)
FIG. 2 (PRIOR ART) is a graph showing the relation between the normalized higher order mode phase constant β/Ko and the normalized attenuation constant α/Ko with respect to frequency f.
Figure 3:
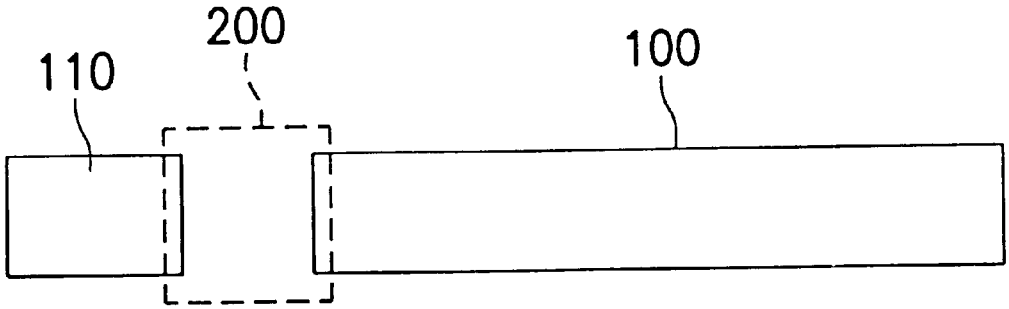
Fig. 3 (PRIOR ART)
FIG. 3 (PRIOR ART) is a schematic view of the conventional microstrip leaky-wave antenna.
Figure 4:
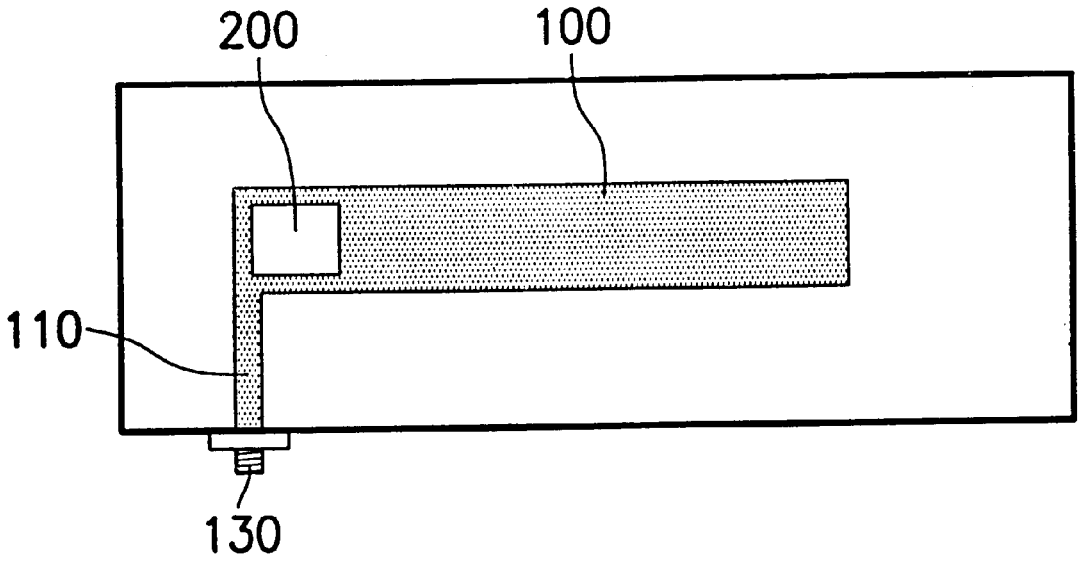
Fig. 4 (PRIOR ART)
FIG. 4 (PRIOR ART) shows a layout diagram of the microstrip leaky-wave antenna in connection with the conventional CBCPS feeding structure.
Figure 5A:
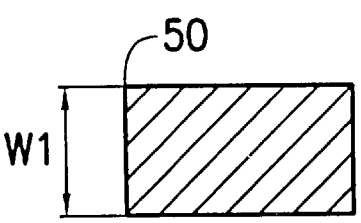
FIGS. 5*a*, 5*b*, 5*c*, 5*d*, 5*e* and 5*f* show several frequency band diagrams of the antenna sections used to combine the wideband microstrip leaky-wave antenna in the preferred embodiment of the present invention.
Figure 5B:
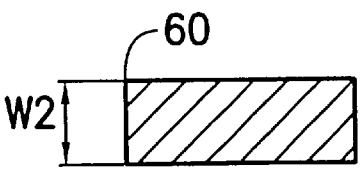
Figure 5C:
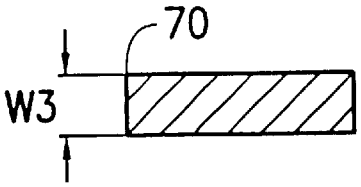
Figure 5D:
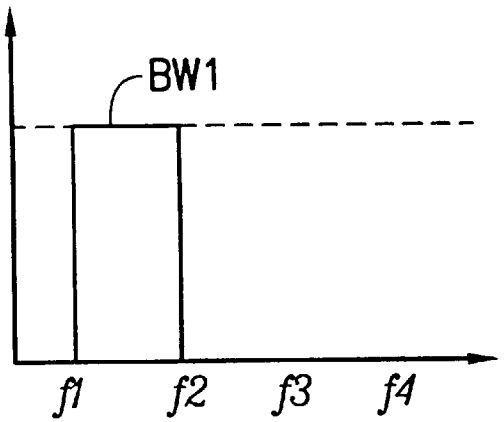
Figure 5E:
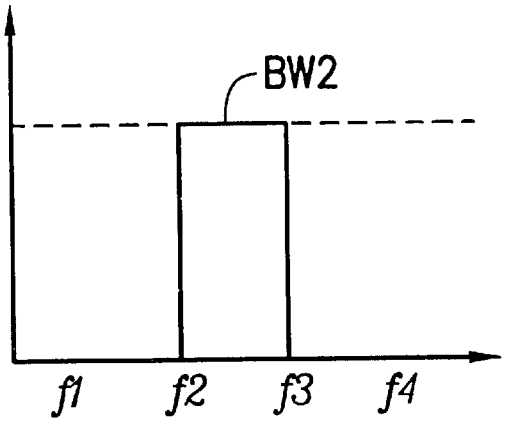
Figure 5F:
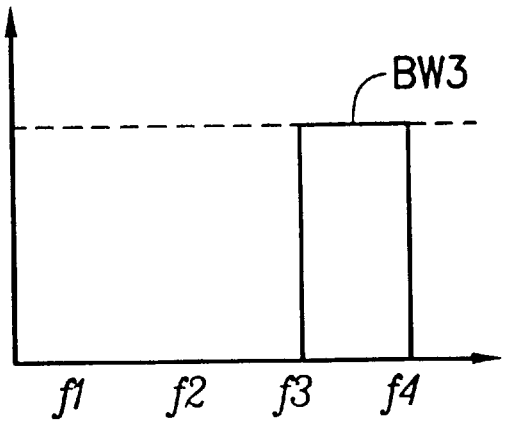

The wideband microstrip leaky-wave antenna disclosed in the present embodiment is acquired by using several microstrip antenna sections with different widths to combine as an integrated source for emitting EM waves. The bands corresponding to these antenna sections with different widths can be joined together as a wide antenna band.

As mentioned above, the approximate ends (i.e. the cut-off frequency) of the bandwidth for the microstrip leaky-wave antenna can be defined by equation (1):

$$f_c = \frac{c}{2W\sqrt{\varepsilon_r}} \tag{1}$$

The range of the space wave region (i.e. the bandwidth) can be defined by equation (2):

$$f_c < f < \frac{f_c\sqrt{\varepsilon_r}}{\sqrt{\varepsilon_r - 1}} \tag{2}$$

Substituting equation (1) into equation (2) can deduce the band range corresponding to a microstrip with a specific width, which can be expressed by equation (3):

$$\frac{c}{2W\sqrt{\varepsilon_r}} < f < \frac{c}{2W\sqrt{\varepsilon_r - 1}} \tag{4}$$

Therefore, the band range of the microstrip can be affected by its width in addition to the dielectric constant of the dielectric layer under the microstrip. Using such feature, the present embodiment can construct the wide-band microstrip leaky-wave antenna.

FIG. 5 shows several frequency-response diagrams of the antenna sections used to combine the wide-band microstrip leaky-wave antenna in this embodiment. FIG. 5 illustrates three antenna sections, including the antenna section 50 with a width w1, the antenna section 60 with a width w2 and the antenna section 70 with a width w3. Operating bands of these antenna sections can be represented by BW1, BW2 and BW3, respectively if each antenna section is considered individually. Since the widths of the microstrips of these antenna sections are different and change discontinuously, the locations of operating bands are different according to equation (4). By properly setting the width parameters, band BW1 is set as the frequency range f1~f2, band BW2 is set as the frequency range f2~f3 and band BW3 is set as the frequency range f3~f4. In addition, these bands are next to each other. Notice that it is acceptable that the locations of these bands can be spaced apart from each other within a predetermined tolerance.

Figure 6A:
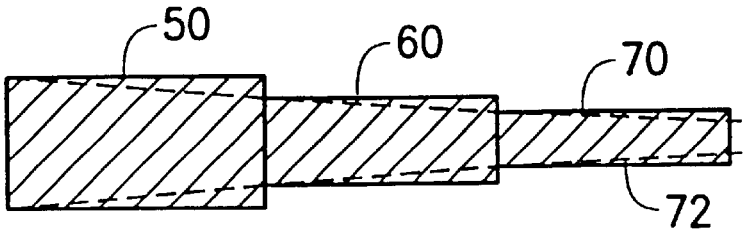
FIG. 6*b* shows a frequency band diagram of the wideband microstrip leaky-wave antenna, shown in FIG. 6*a*, of the preferred embodiment of present invention.
Figure 6B:
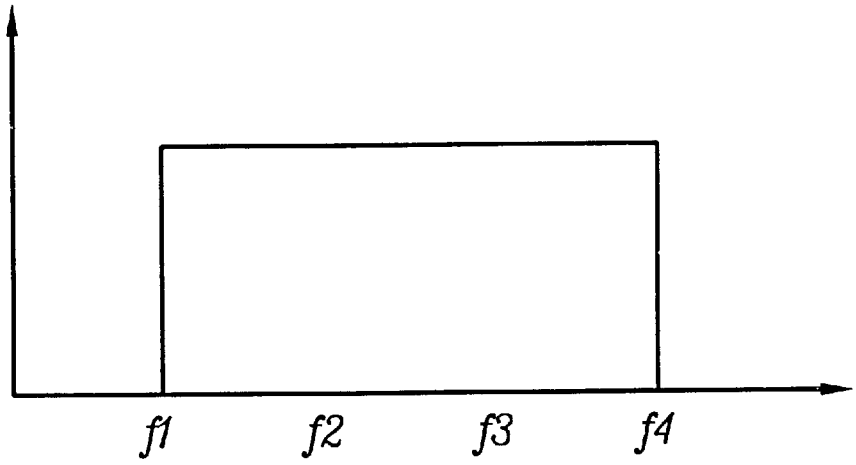

FIG. 6*b* shows a frequency response diagram of the wide-band microstrip leaky-wave antenna in the embodiment of the present invention. As shown in FIG. 6*a*, the antenna sections 50, 60 and 70 are sequentially connected with each other based on the criteria of the decreased width. Therefore, the bands of these antenna sections can be cascaded to increase the bandwidth of the whole antenna. It is understood that the invention is not limited to the disclosed embodiment that utilizes three antenna sections. Utilizing four or more antenna sections also can achieve the similar effect as well. In particular, when the technique disclosed above is practically utilized, the pattern of discontinuous widths illustrated by the solid line of FIG. 6*a* can cause electromagnetic reflections at discontinuity, which degrades the performance of the antenna. The dash line 72 in FIG. 6*a* shows the pattern of the optimized design, where the widths of the antenna sections continuously vary. It can prevent from the reflecting phenomenon between these antenna sections with different widths. Moreover, the contour of the continuously varying widths can be linear or in other curves.

Figure 7:
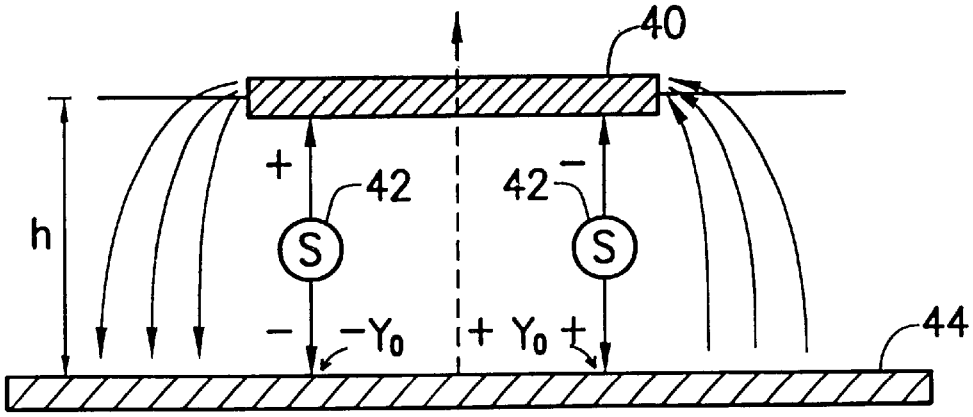
FIG. 7 is a diagram showing the cavity model pertaining to the microstrip leaky-wave antenna.

As mentioned above, even if the bandwidth of the microstrip used as the leaky wave source is wide enough, the bandwidth of the whole antenna will be limited by the bandwidth of the feeding system. Therefore, it is inevitable to provide a wide-band feeding system for the wide-band microstrip. The feeding structure adopted by this embodiment is deduced by the impedance characteristic acquired by the cavity model of the microstrip antenna. As shown in FIG. 7, numeral 40 represents a microstrip. Numeral 44 represents a grounded metal plate. Numeral 42 represents an exciting source as input. The exciting source 42 has symmetric inputs, which means that there are two inputs with the same amplitudes and the phase difference 180°. The impedance characteristic acquired by the cavity model is expressed as:

$$Z_c = \frac{8Z_0 k_0 \sin\left(\frac{\pi Y_0}{W_{eff}}\right)^2 h}{W_{eff}(\beta - j\alpha)} \tag{5}$$

, wherein $Z_0$ is 377 Ω, $K_0$ is the phase constant in air, h is the thickness of the substrate, $Y_0$ is the location of the exciting source 42 (or called a observatory point) and $W_{eff}$ is an effective width of the microstrip (considering the effect of fringing-edge electric field).

According to equation (5), characteristic impedance $Z_c$ only varies with the location $Y_o$ of the exciting source 42 and to β−jα. Other parameters are constants. Therefore, as β−jα slowly varies, the optimized bandwidth of the antenna matching (feeding) can be obtained by selecting parameter $Y_o$ appropriately. In the present embodiment, the objective is achieved by adding a balance-to-unbalance transformer (abbreviated by balun).

Figure 8:
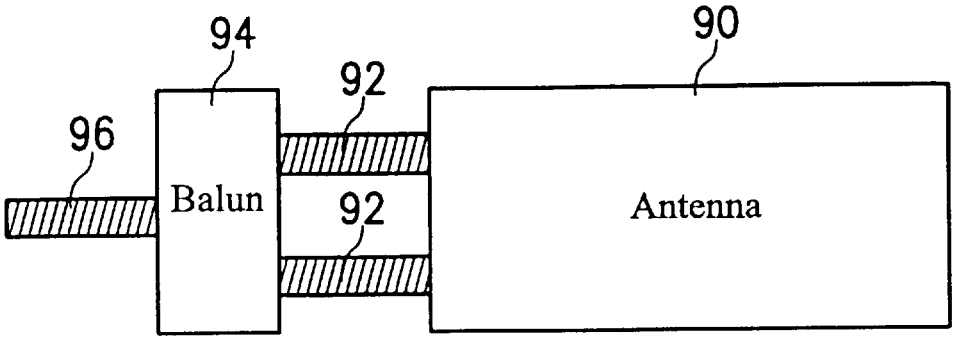
FIG. 8 is a diagram of the feeding system applied to the wideband microstrip leaky-wave antenna in the preferred embodiment of the present invention.
Figure 9:
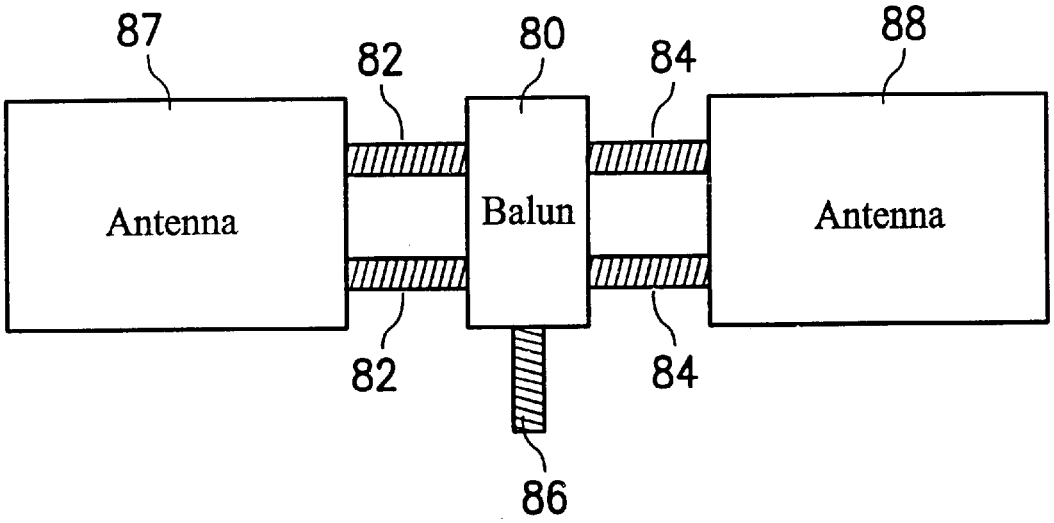
FIG. 9 is a diagram of the feeding system applied to the dual-major-lobe wideband microstrip leaky-wave antenna in the preferred embodiment of the present invention.
Figure 10:
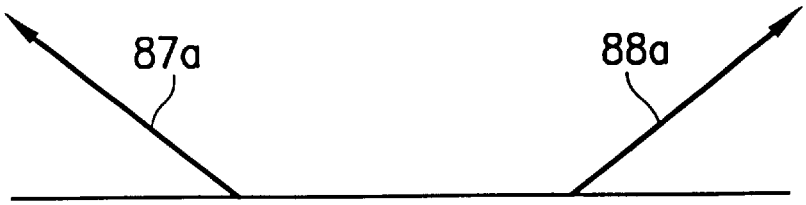
FIG. 10 is a diagram showing the dual main lobes for the dual-major-lobe wideband microstrip leaky-wave antenna in the preferred embodiment of the present invention.

FIG. 8 shows a schematic view of the feeding system applied to the wide-band microstrip leaky-wave antenna in the embodiment. In FIG. 8, numeral 90 represents the major part of the antenna, numeral 94 represents the balun. In addition, there are two strips of CBCPS 92 between the major portion 90 and the balun 94. In addition, there is a metal bottom plate (not shown) on the other side of the substrate (not shown) opposite to the CBCPS 92. In addition, the other side of the CBCPS 92 opposite to the balun 94 is connected to an input microstrip 96 for receiving input energy. It is noticed that the balun in this embodiment should be the Marchand Balun and the like, and cannot be the feeding system that is constructed by a power divider and a branching component with a phase difference of 180°. The latter one has only 20% of the original bandwidth and cannot be utilized for wideband applications. In fact, the feeding system mentioned above also can be utilized for antennas with dual major lobes. FIG. 9 shows a schematic view of the feeding system applied to the dual-major-lobe wideband microstrip leaky-wave antenna. As shown in FIG. 9, numerals 87 and 88 represent the major portions of the antenna for generating two major lobes of the leaky waves with directional symmetry. A CBCPS 82 is used to connect the balun 80 and the antenna body 87 and a CBCPS 84 is used to connect the balun 80 and the antenna body 88. The other side of the balun 80 is connected with an input microstrip 86 for receiving energy. FIG. 10 is a schematic diagram showing the directions of the two major lobes of the dual-major-lobe wideband microstrip leaky-wave antenna in this embodiment. It is noticed that major lobes 87*a* and 88*a* are generated by antenna body 87 and antenna body 88 that share the same feeding system.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A wideband microstrip leaky-wave antenna, comprising a plurality of antenna sections;

wherein each of the antenna sections includes a microstrip line for leaking energy;

wherein the microstrip lines of the antenna sections have different widths and the antenna sections are directly and sequentially connected in an order of the decreasing widths of the microstrip lines therein;

wherein frequency bands of the antenna sections depends on the widths of the microstrip lines therein; and wherein the frequency bands of the antenna sections constitute an antenna band of the wideband microstrip leaky-wave antenna.

2. The wideband microstrip leaky-wave antenna as recited in claim 1, further comprising a feeding structure, the feeding structure further comprising:

at least one pair of conductor-backed coplanar strips connected to an end of the connected antenna sections;

a wideband balance-to-unbalance transformer connected to the pair of the conductor-backed coplanar strips; and an input microstrip, connected to the wideband balance-to-unbalance transformer, for receiving and transmitting energy to the end of the connected antenna sections through the pair of the conductor-backed coplanar strips and the wideband balance-to-unbalance transformer.

3. The wideband microstrip leaky-wave antenna as recited in claim 2, further comprising:

a metal bottom plate located under the pair of the conductor-backed coplanar strips; and a dielectrics layer located between the metal bottom plate and the pair of the conductor-backed coplanar strips.

4. The wideband microstrip leaky-wave antenna as recited in claim 2, wherein the wideband balance-to-unbalance transformer is a Marchand type balance-to-unbalance transformer.

5. A antenna-feeding structure, connected to a microstrip line, for conveying energy to the microstrip line, the microstrip line serving as a wave source, comprising:

at least one pair of conductor-backed coplanar strips connected to an end of the microstrip line;

a wideband balance-to-unbalance transformer connected to the pair of the coductor-backed coplanar strips; and an input microstrip line, connected to the wideband balance-to-unbalance transformer, for receiving and transmitting the energy to the end of the microstrip line through the pair of the conductor-backed coplanar strips and the wideband balance-to-unbalance transformer.

6. The antenna-feeding structure as recited in claim 5, further comprising:

a metal bottom plate located under the pair of the conductor-backed coplanar strips; and a dielectrics layer located between the metal bottom plate and the pair of the conductor-backed coplanar strips.

7. The antenna-feeding structure as recited in claim 5, wherein the wideband balance-to-unbalance transformer is a Marchand type balance-to-unbalance transformer.

8. An antenna-feeding structure connected to a first microstrip line and a second microstrip line, for conveying energy to the first microstrip line and the second microstrip line, the first microstrip line and the second microstrip line serving as wave sources for emitting electromagnetic waves with symmetric main lobes in directions, comprising:

at least one first pair of conductor-backed coplanar strips connected to a first end of the first microstrip line;

at least one second pair of conductor-backed coplanar strips connected to a second end of the second microstrip line; a wideband balance-to-unbalance transformer with a first edge connected to the first pair of the coductor-backed coplanar strips and the second edge connected to the second pair of the conductor-backed coplanar strips; and an input microstrip line, connected to the wideband balance-to-unbalance transformer, for receiving and transmitting the energy to the first end of the first microstrip line and the second end of the second microstrip line through the first pair of the conductor-backed coplanar strips, the second pair of the conductor-backed coplanar strips and the wideband balance-to-unbalance transformer.

9. The antenna-feeding structure as recited in claim 8, further comprising:

a metal bottom plate located under the first pair of the conductor-backed coplanar strips; and a dielectrics layer located between the metal bottom plate and the first pair of the conductor-backed coplanar strips.

10. The antenna-feeding structure as recited in claim 8, further comprising:

a metal bottom plate located under the second pair of the conductor-backed coplanar strips; and a dielectrics layer located between the metal bottom plate and the second pair of the conductor-backed coplanar strips.

11. The antenna-feeding structure as recited in claim 8, wherein the wideband balance-to-unbalance transformer is a Marchand type balance-to-unbalance transformer.

* * * * *